US008453294B2

(12) United States Patent
Lee

(10) Patent No.: US 8,453,294 B2
(45) Date of Patent: Jun. 4, 2013

(54) UPRIGHT VACUUM CLEANER HAVING PATH SWITCHING APPARATUS

(75) Inventor: Byung-jo Lee, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/343,344

(22) Filed: Jan. 4, 2012

(65) Prior Publication Data

US 2012/0180252 A1 Jul. 19, 2012

(51) Int. Cl.
*A47L 5/32* (2006.01)

(52) U.S. Cl.
USPC ..... 15/331; 15/334; 15/335

(58) Field of Classification Search
USPC ..... 15/331, 334, 335
IPC ..... A47L 5/32
See application file for complete search history.

(56) References Cited

U.S. PATENT DOCUMENTS

| | | | |
|---|---|---|---|
| 5,477,586 | A | 12/1995 | Jacobs et al. |
| 7,676,883 | B2 | 3/2010 | Macleod et al. |
| 2007/0289087 | A1 | 12/2007 | Macleod et al. |
| 2009/0089959 | A1 | 4/2009 | Lee et al. |
| 2010/0005611 | A1 | 1/2010 | Hong et al. |

FOREIGN PATENT DOCUMENTS

| | | | |
|---|---|---|---|
| GB | 2 425 045 | A | 10/2006 |
| GB | 2 453 617 | A | 4/2009 |
| KR | 10-2009-0035996 | | 4/2009 |
| KR | 10-2010-0006787 | | 1/2010 |
| KR | 10-2010-0111603 | | 10/2010 |
| WO | 2005/117676 | A1 | 12/2005 |

OTHER PUBLICATIONS

United Kingdom Search Report issued Apr. 30, 2012 in corresponding United Kingdom Patent Application BG1200559.1.

*Primary Examiner* — David Redding
(74) *Attorney, Agent, or Firm* — Staas & Halsey LLP

(57) ABSTRACT

An upright vacuum cleaner having a path switching apparatus are provided. The upright vacuum cleaner may include: a cleaner body, a hose which introduces air including dust into a dust collection unit, an extension pipe which is connected to the hose and is attached to/detached from the cleaner body, a suction port assembly connected to a bottom of the cleaner body, and a path switching apparatus installed in the cleaner body. The path switching apparatus includes an actuator, a rotary valve which pivotally rotates when the actuator operates, and a valve housing in which the rotary valve is built, wherein the rotary valve is curvedly formed so that the rotary valve forms a duct along with an inner circumferential surface of the valve housing to select a first path or a second path.

15 Claims, 5 Drawing Sheets

UPRIGHT VACUUM CLEANER HAVING PATH SWITCHING APPARATUS

CROSS-REFERENCE TO RELATED APPLICATIONS

This application claims priority benefit from Korean Patent Application No. 10-2011-0004475, filed on Jan. 17, 2011, in the Korean Intellectual Property Office, the disclosure of which is incorporated herein by reference in its entirety.

BACKGROUND

1. Field

Embodiments relate to an upright vacuum cleaner having path switching apparatus and, more particularly, to a path switching apparatus in which a path is selectively changed by attaching/detaching an extension pipe of an upright vacuum cleaner to/from a cleaner body and the upright vacuum cleaner having a path switching apparatus.

2. Description of the Related Art

Typically, vacuum cleaners are classified into upright type vacuum cleaners and canister type vacuum cleaners.

In the upright vacuum cleaners, a suction port assembly and a cleaner body are directly connected without a separate hose or an extension pipe and can improve cleaning efficiency using body weight of the vacuum cleaner in cleaning a carpet.

On the other hand, in the canister vacuum cleaners, a suction port assembly and a cleaner body are interconnected to each other via a hose and an extension pipe different from the upright vacuum cleaners so that it is possible to freely manipulate the suction port assembly, as compared with manipulating the suction port assembly connected to a bottom of the upright vacuum cleaner.

When cleaning a floor, stair's or a narrow area using the upright vacuum cleaner, the cleaning is not as easy as the canister vacuum cleaner due to the manipulation difference in the upright vacuum cleaner and the canister vacuum cleaner.

To resolve the above problems, upright vacuum cleansers operable in a canister mode and an upright mode have been developed.

The upright vacuum cleaners of the related art include a flexible hose and an extension pipe in a cleaner body and adapt a path switching structure which switches a suction path to introduce dust of a surface to be cleaned and air into a dust collection unit via an extension pipe when cleaning in the canister mode.

In the path switching structure, when a rotary valve hinge-connected to a pivot shaft of a valve housing is path-switched, a friction is caused between a connection part of the rotary value and the pivot shaft so that the connection part is abraded. Thereby, the rotary valve unsmoothly rotates with long use.

In addition, it is difficult to maintain airtight while the path is switched in the path switching structure of the related art so that there is concern about leakage of fluid.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide a path switching apparatus capable of performing a smooth rotation by allowing a predetermined clearance in hinge connection between a rotary valve and a valve housing and an upright vacuum cleaner having the same.

One or more exemplary embodiments further provide a path switching apparatus capable of maintaining airtight for a path selected by a rotary valve in path switching and an upright vacuum cleaner having the same.

According to an aspect of an exemplary embodiment, there is provided a upright vacuum cleaner. The upright vacuum cleaner may include: a cleaner body, a hose which introduces air including dust into a dust collection unit, an extension pipe which is connected to the hose and is attached to/detached from the cleaner body, a suction port assembly connected to a bottom of the cleaner body, and a path switching apparatus is installed in the cleaner body.

The path switching apparatus includes an actuator, a rotary valve which pivotally rotates when the actuator operates, and a valve housing in which the rotary valve is built, wherein the rotary valve is curvedly formed so that the rotary valve forms a duct along with an inner circumferential surface of the valve housing to select a first path or a second path.

The valve housing of the path switching apparatus may include two inlet ports and one outlet port, one of the two inlet ports being interconnected to the hose, the other being interconnected to the suction port assembly, and the outlet port being interconnected to the dust collection unit. The extension pipe may pressurize the actuator when the extension pipe is attached to the cleaner body and the actuator is released when the extension pipe is detached from the cleaner body so that a first path or a second path is selectively switched.

The valve housing may include two inlet ports and one outlet port which extend to the same angle on the basis of a center thereof. The rotary valve may interconnect any one of the two inlet ports and the outlet port to each other and close the remaining inlet.

When the actuator is pressurized to a linear direction or released and returns to an original position, the rotary valve may rotate in a clockwise direction or a counterclockwise direction.

The actuator may be elastically disposed outside the valve housing and in this case, the valve housing may include at least one pair of guide ribs which guide the actuator to the linear direction.

The actuator may include cam holes which are in cam contact with connection protrusions protruded from an outer circumference of the rotary valve to control rotation of the rotary valve. In this case, the cam holes of the actuator may have a larger width than a diameter of the connection protrusions to have a clearance with the connection protrusions of the rotary valve.

The connection protrusions of the rotary valve may be slidably inserted into the valve housing and the valve housing may include guide holes corresponding to a rotational trajectory of the connection protrusions.

The rotary valve may include a hinge hole in which a hinge shaft of the valve housing is inserted and the hinge hole may be formed to have a clearance with the hinge shaft. In this case, the hinge hole may have a circular shape or an elliptical shape. The hinge hole may have a circular shape wherein the hinge hole may be an atypical circle.

The rotary valve may include a packing which is joined along an outer circumference thereof and is tightly adhered to an inner surface of the valve housing so that leakage of a selected path can be prevented.

The actuator may have an inverse U shape and be cam-connected to both sides of the rotary valve.

The inlet port interconnected to the suction port assembly may be disposed in a downward direction of the valve housing and the inlet port interconnected to the hose and the outlet port may be disposed left and right.

The actuator may include a unit to be pressurized, which the extension pipe duly reaches, in a top thereof.

Additional aspects and advantages of the exemplary embodiments will be set forth in the detailed description, will be apparent from the detailed description, or may be learned by practicing the exemplary embodiments.

BRIEF DESCRIPTION OF THE DRAWINGS

The above and/or other aspects will be more apparent by describing in detail exemplary embodiments, with reference to the accompanying drawings, in which.

DETAILED DESCRIPTION

Figure 1:
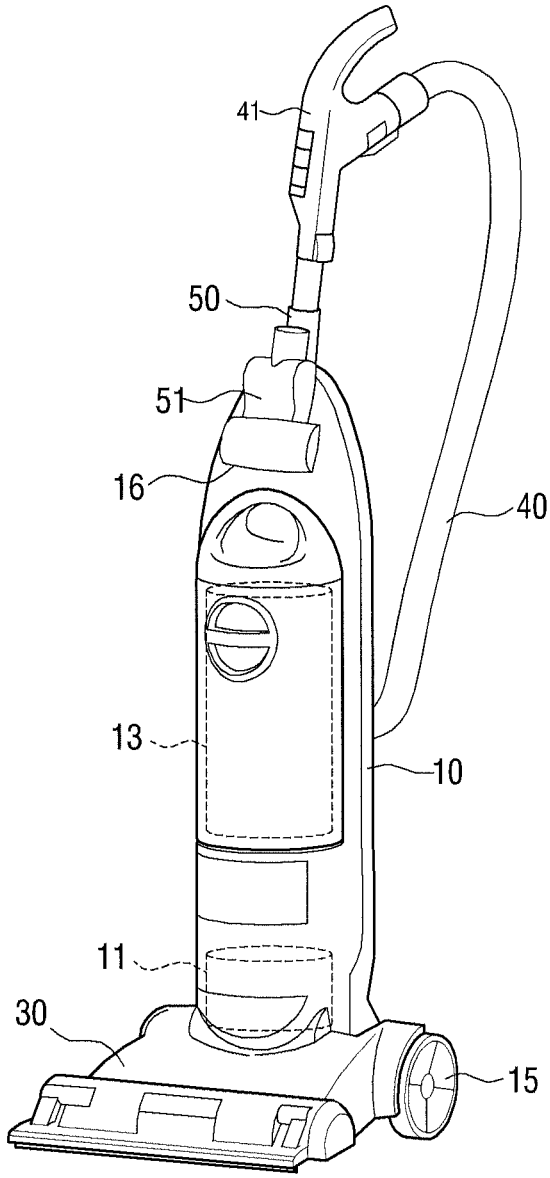
FIG. 1 is a perspective view illustrating an upright vacuum cleaner according to an exemplary embodiment.

Hereinafter, a configuration of an upright vacuum cleaner including a path switching apparatus according to exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Figure 2:
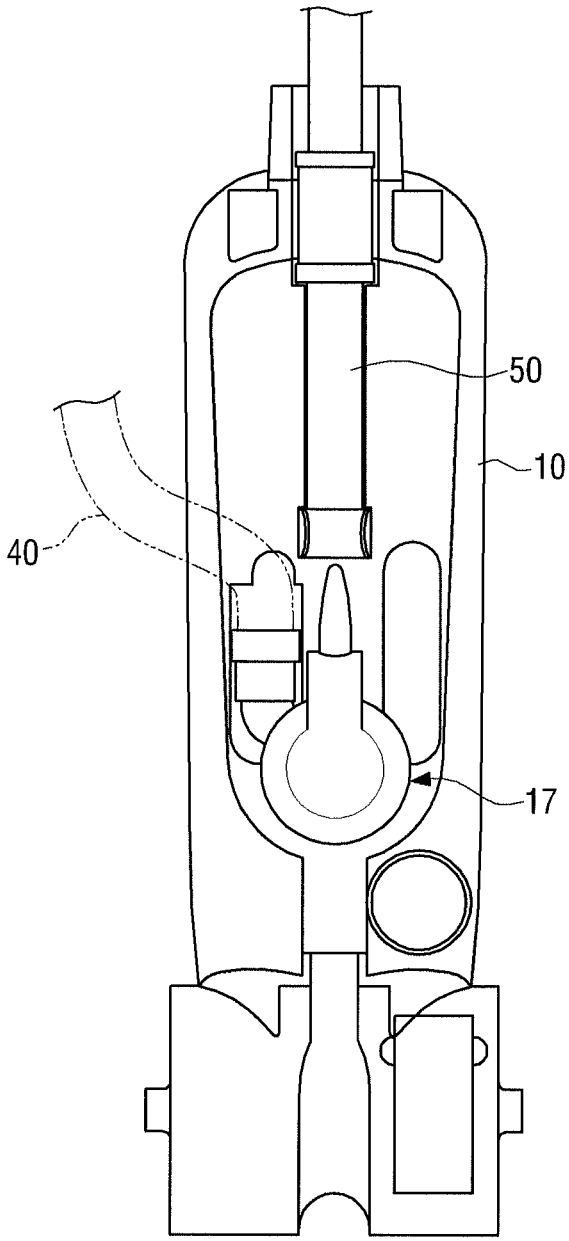
FIG. 2 is a rear view illustrating a cleaner body in which a path switching apparatus is built.

Referring to FIGS. 1 and 2, an upright vacuum cleaner includes a cleaner body 10, a suction port assembly 30, an extension pipe 50 and a path switching apparatus 100.

A suction motor 11, which generates suction force, is installed inside the cleaner body 10, and a dust collection unit 13, which separates filth from air flowed into the cleaner body 10 on a surface to be cleaned by the suction force of the suction motor 11, and collects the dust, is installed inside the cleaner body 10. In addition, a pair of wheels 15, which allows the cleaner body 10 to smoothly move on the surface to be cleaned, are installed in a bottom of the cleaner body 10.

Referring to FIG. 2, the cleaner body 10 includes a mounting unit 16, which mounts an accessory brush 51 and is disposed in the upper side, of a front thereof. In addition, the cleaner body 10 includes a container 17 which is disposed in a back side of inside of the cleaner body 10 and in which the path switching apparatus 100 is installed.

The suction port assembly 30 is interconnectably hinge-connects to a bottom of the cleaner body 10 and sucks dust on the surface to be cleaned and air. The suction port assembly 30 is interconnected to the path switching apparatus 100 through a predetermined interconnection member (not shown).

One terminal of the extension pipe 50 is interconnected to a handle assembly 41, and the accessory brush 51 is detachably joined to the other terminal of the extension pipe 50.

When the upright vacuum cleaner is used in an upright mode, the extension pipe 50 is substantially vertically attached to a rear of the cleaner body 10 while the accessory brush 51 is detached from the other terminal of the extension pipe 50. At this time, the other terminal of the extension pipe 50 pressurizes a part of an actuator 150 of the path switching apparatus 100 by a body weight of the extension pipe 50. In this case, the path switching apparatus 100 operates so that a first path P1 is selected and description thereof will be described below in further detail.

When the upright vacuum cleaner is used in a canister mode, the extension pipe 50 is detached from the cleaner body 10 and is used with the accessory brush 51 attached to the other terminal thereof. The dust sucked through the accessory brush 51 and the extension pipe 50 is sucked into a second inlet port 113*b* of the path switching apparatus 100 sequentially through the handle assembly 41 and a flexible hose 40. In this case, one terminal of the flexible hose 40 is interconnected to the handle assembly 41 and the other terminal of the flexible hose 40 is interconnected to the second inlet port 113*b* of the path switching apparatus 100. When the extension pipe 50 is detached from the cleaner body 10, the path switching apparatus 100 operates so that a second path P2 is selected.

Figure 3:
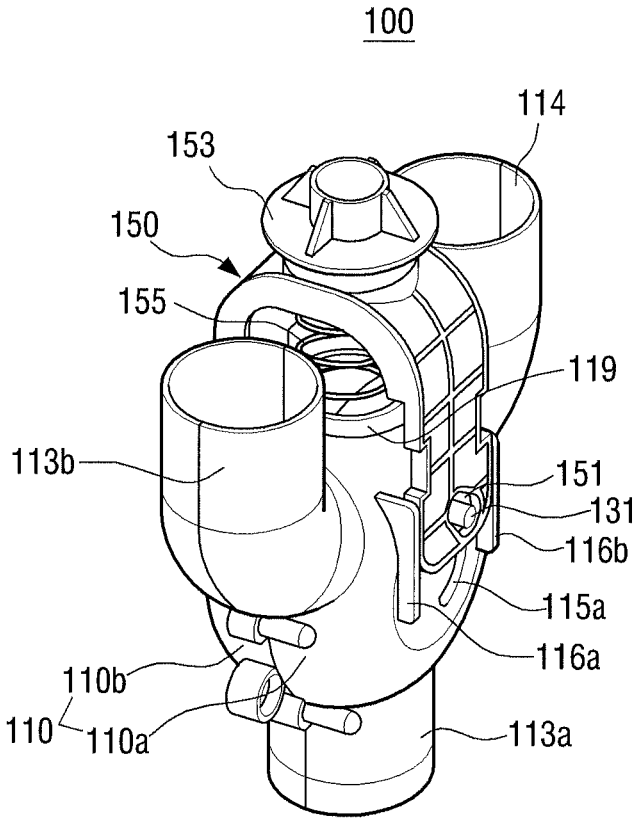
FIG. 3 is a perspective view illustrating a path switching apparatus.
Figure 5:
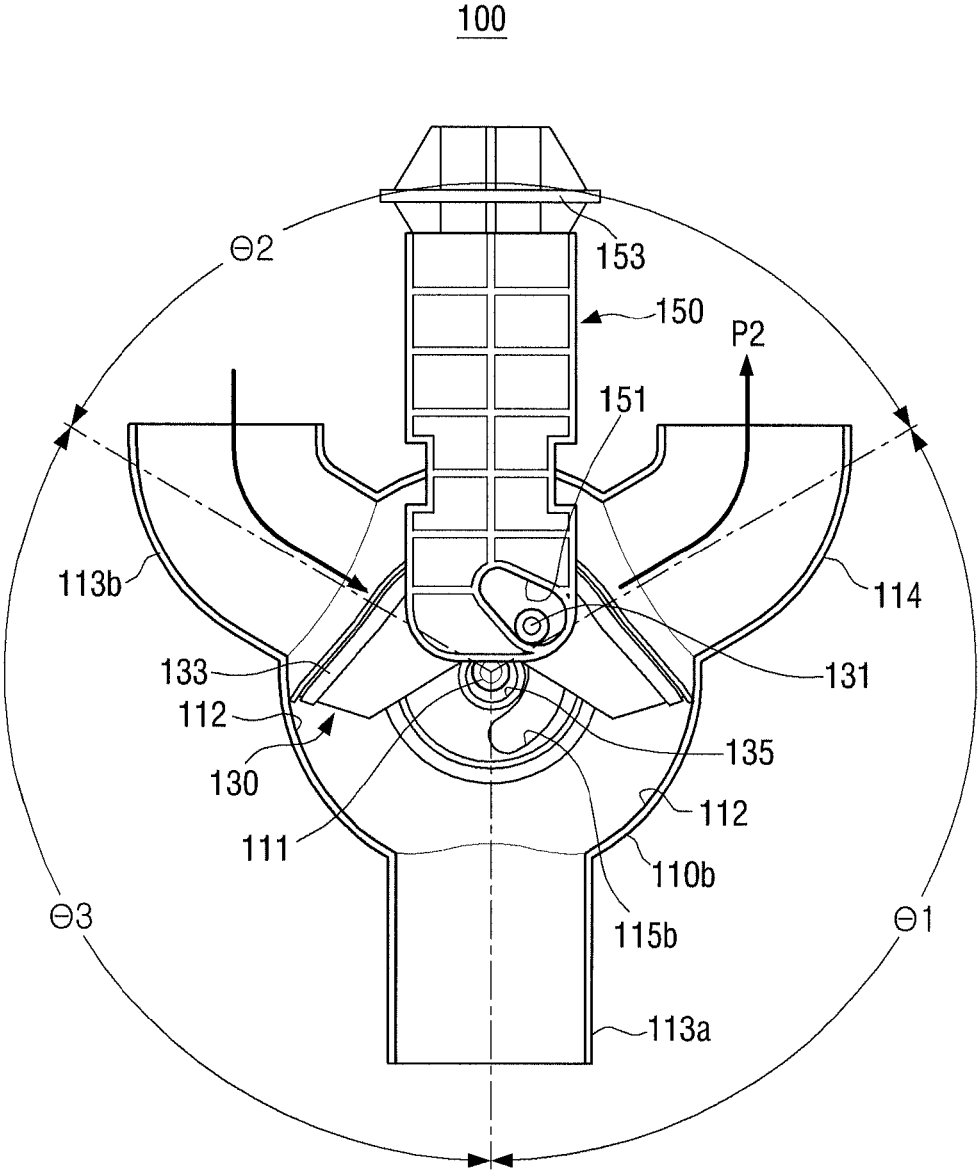
FIG. 5 is a schematic diagram illustrating a state that a second path is selected by a path switching apparatus when an extension pipe is detached from a cleaner body

Referring to FIGS. 3 and 5, the path switching apparatus 100 includes a valve housing 110, a rotary valve 130 and the actuator 150.

The valve housing 110 includes a front part 110*a* and a rear part 110*b* which are symmetrically joined to each other and the rotary valve 130 is installed in a pivot state inside the valve housing 110 to be rotated in a clockwise direction or in a counterclockwise direction. In this case, a hinge shaft 111, which the rotary valve 130 is pivotally connected to, is formed substantially in a center of the valve housing 110.

In addition, the valve housing 110 includes a first inlet port 113*a*, the second inlet port 113*b* and an outlet port 114. The first inlet port 113*a* is disposed in a lower section of the valve housing 110 and interconnected to the suction port assembly 30. The second inlet port 113*b* is disposed on the left side of the valve housing 110 and interconnected to the flexible hose 40. The outlet port 114 is disposed on the right side of the valve housing 110 and interconnected to the dust collection unit 13 through a predetermined connection path (not shown).

In this case, the first and second inlet ports 113*a* and 113*b* and the outlet port 114 are disposed substantially at the same angle ($\theta 1=\theta 2=\theta 3$) on the hinge shaft 111 of the valve housing 110. The arrangement angle of the first and second inlet ports 113*a* and 113*b* and the outlet port 114 is closely related to a degree of the curvature of the rotary valve 130. That is, the degree of the curvature of the rotary valve 130 is determined according to the angle $\theta 1$ between the first inlet port 113*a* and the outlet port 114, the angle 62 between the second inlet port 113*b* and the outlet port 114, and the angle $\theta 3$ between the first inlet port 113*a* and the second inlet port 113*b*.

Further, guide holes 115*a* and 115*b* are formed in the front and rear parts 110*a* and 110*b* of the valve housing 110 with mutual symmetry along the periphery of the hinge shaft 111. The guide holes 115*a* and 115*b* are formed to have curvatures corresponding to rotational trajectories of connection protrusions 131 of the rotary valve 130.

Thereby, the connection protrusions 131 of the rotary valve 130 are slidably penetrated the guide holes 115*a* and 115*b* so that the guide holes 115*a* and 115*b* guide rotation of the rotary valve 130. In this case, lengths of the guide holes 115*a* and 115*b* are predetermined so that the rotation angle of the rotary valve 130 can be limited.

In addition, a pair of guide ribs 116*a* and 116*b* are respectively formed in outer sides of the front and rear parts 110*a* and 110*b* to guide the actuator 150 to move in a linear direction.

Referring to FIG. 5, the rotary valve 130 selectively forms a duct, which interconnects the first inlet port 113*a* and the outlet 114 along with the valve housing 110 and a duct in the upright mode, and which interconnects the second inlet port 113*b* and the outlet port 114 along with the valve housing 110 in the canister mode.

In this case, the rotary valve 130 is formed to be curved at a predetermined angle. It is preferable that the rotary valve 130 be formed to have a degree of the curvature which satisfies the condition that interconnects the first inlet port 113*a* and the outlet port 114 and simultaneously disinterconnects the second inlet 113*b* and the outlet port 114 in the upright mode and the condition that interconnects the second inlet port 113*b* and the outlet port 114 and simultaneously disinterconnects the first inlet port 113*a* and the outlet port 114 in the canister mode.

A packing 133 is jointed along an outer circumference of the rotary valve 130. The packing 133 is tightly adhered to an inner surface 112 of the valve housing 110 so that the packing 133 can maintain airtight of the first path P1 or the second path P2 along with the valve housing 110.

A hinge hole 135, which the hinge shaft 111 of the valve housing 110 is inserted into, is formed substantially in a center of the rotary valve 130. The hinge hole 135 substantially has a circular shape or an elliptical shape. In addition, the hinge hole 135 has a circular shape, wherein the hinge hole 135 is formed in an atypical circle so that the hinge hole 135 can be formed to have a clearance with the hinge shaft 111.

As described above, according to a predetermined clearance between the hinge hole 135 of the rotary valve 130 and the hinge shaft 111, the rotary valve 130 is deviated from a center of rotation, that is, a pivot of the hinge shaft 111 to a predetermined distance and returns to the pivot of the hinge shaft 111 again when the rotary valve rotates so that friction between the hinge shaft 111 and the hinge hole 135 can be minimized.

The connection protrusions 131 are respectively formed in the front and rear of the rotary valve 130 so that the rotary valve 130 can be rotated in link with a linear motion. In this case, the connection protrusions 131 are formed substantially parallel to the hinge shaft 111 of the valve housing 110 and sequentially penetrate the guide holes 115*a* and 115*b* of the valve housing 110 and cam holes 151 of the actuator 150.

The actuator 150 substantially has an inverse U shape to surround the front and rear of the valve housing 110 from a top of the valve housing 110. The cam holes 151, which are in cam contact with the respective connection protrusions 131 of the rotary valve 130, are formed in a lower side of the actuator 150.

The cam holes 151 have a larger width than a diameter of the connection protrusions 131 and are formed substantially in an oblique direction with respective to a length direction of the actuator 150. Thereby, when the actuator 150 makes a linear motion, the connection protrusions 131 of the rotary valve 130 slidably move while the connection protrusions 131 of the rotary valve 130 are in cam contact with the cam holes 151 so that the connection protrusions 131 rotates the rotary valve 130 in a clockwise direction or in a counterclockwise direction.

A unit 153 to be pressurized, which the terminal of the extension pipe 50 duly reaches, is formed in an upper center of the actuator 150. In the case where the extension pipe 50 is attached to the cleaner body 10, the actuator 150 is pressed by the body weight of the extension pipe 150 to linearly move downwardly when the terminal of the extension pipe 50 duly reaches the unit 153 to be pressurized.

In this case, the actuator 150 maintains an elevated state in a direction growing apart from the valve housing 110 by an elastic member 155 which is disposed between the valve housing 110 and the actuator 150. Here, it is preferable that a coil spring be used as the elastic member 155. One terminal of the coil spring is inserted into a supporting groove 119 and the other terminal of the coil spring is safely supported to an inner surface of the upper part of the actuator 150.

A path switching operation of the upright vacuum cleaner including the path switching apparatus having above described configuration according to the exemplary embodiment will be described with reference to FIGS. 4 and 5. For convenience, FIGS. 4 and 5 illustrate the state that the front part 110*a* of the valve housing 110 is omitted to clearly show path switching.

Figure 4:
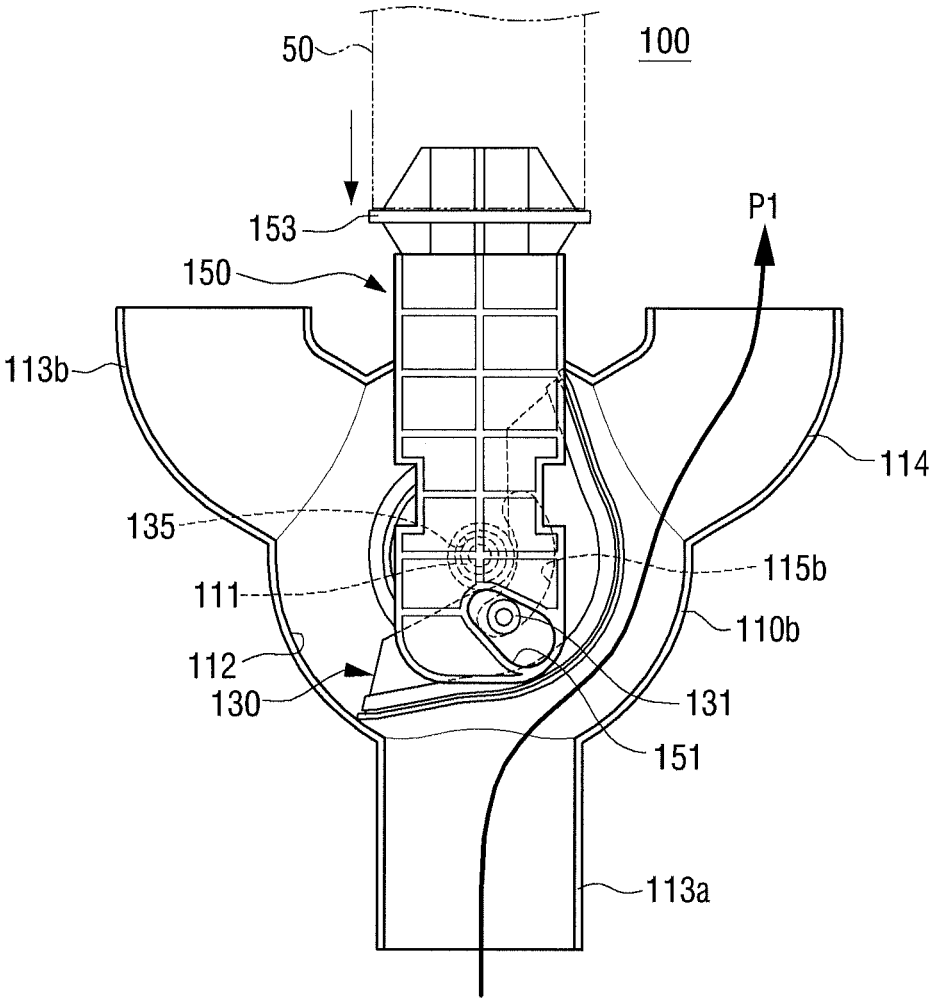
FIG. 4 is a schematic diagram illustrating a state that a first path is selected by a path switching apparatus when an extension pipe is attached to a cleaner body.

Referring to FIG. 4, first, when the upright vacuum cleaner performs a cleaning operation in an upright mode, the extension pipe 50 is attached to the rear of the cleaner body 10 substantially in a vertical direction.

The terminal of the extension Pipe 50 duly reaches the unit 153 to be pressurized of the actuator 150 and the actuator 150 is elastically vertically descended by the elastic member 155, for example, the coil spring (see FIG. 3).

According to the descending of the actuator 150, the connection protrusions 131 of the rotary valve 130 slidably moves while the connection protrusions 131 of the rotary valve 130 are in cam contact with the cam holes 151 of the actuator 150. Thereby, the rotary valve 130 rotates to a predetermined angle in a counterclockwise direction so that the rotary valve 130 mutually interconnects the first inlet port 113*a* and the outlet port 114 to form the first path P1.

In this case, a pivot of the rotary valve 130 moves to a predetermined distance from the hinge shaft 111 in one direction and returns to an original position again by the clearance formed between the hinge hole 135 and the hinge shaft 111 of the valve housing 110. Thereby, friction between the hinge shaft 111 and the hinge hole 135 can be minimized.

As described above, the first path P1 is formed within the path switching apparatus 100 so that the dust on the surface to be cleaned, which is sucked into the path switching apparatus 100 through the suction port assembly 30, passes through the first path P1 of the path switching apparatus 100 and flowed into the dust collection unit 13 along with air.

Subsequently, referring to FIG. 5, when cleaned using the upright vacuum cleaner in a canister mode, the extension pipe 50 is detached from the cleaner body 10.

Thereby, the actuator 150, which has been pressed by the body weight of the extension pipe 50 as shown in FIG. 4, is vertically elevated by the elastic member 155 (see FIG. 3). In addition, the connection protrusions 131 of the rotary valve 130 slidably moves while the connection protrusions 131 of the rotary valve 130 are in cam contact with the cam holes 151 of the actuator 150.

Thus, the rotary valve 130 rotates to a predetermined angle in the clockwise direction so that the rotary valve 130 mutually interconnects the second inlet port 113*b* and the outlet port 114 to form the second path P2. In this case, a pivot of the rotary valve 130 moves to a predetermined distance from the hinge shaft 111 in one direction and returns to an original position again by the clearance formed between the hinge hole 135 and the hinge shaft 111 of the valve housing 110, as in the upright mode. Thereby, friction between the hinge shaft 111 and the hinge hole 135 can be minimized.

As described above, the second path P2 is formed within the path switching apparatus 100 so that the dust on the surface to be cleaned, which is sucked into the path switching apparatus 100 sequentially passing through the accessory brush 51, the extension pipe 50, the handle assembly 41 and the flexible hose 40 and flows into the dust collection unit 13 along with air through the second path P2 of the path switching apparatus 100.

In the above described exemplary embodiment, friction between the hinge shaft 111 of the valve housing 110 and the hinge hole 135 of the rotation valve 130 can be minimized in path switching so that unsmooth rotation of the rotary valve 130 due to abrasion of the connection part can be improved.

Further, airtight of the selected path can be maintained by the packing 133 joined to the rotary valve 130 so that leakage of fluid penetrating the path switching apparatus 100 can be prevented.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An upright vacuum cleaner, comprising:

a cleaner body;

a hose which introduces air including dust into a dust collection unit;

an extension pipe which is connected to the hose and is attached to/detached from the cleaner body;

a suction port assembly connected to a bottom of the cleaner body; and a path switching apparatus installed in the cleaner body, wherein the path switching apparatus includes an actuator, a rotary valve which pivotally rotates when the actuator operates, and a valve housing in which the rotary valve is built, wherein the rotary valve is curvedly formed so that the rotary valve forms a duct along with an inner circumferential surface of the valve housing to select a first path or a second path, wherein the valve housing of the path switching apparatus includes two inlet ports and the outlet port, one of the two inlet ports being interconnected to the hose, the other being interconnected to the suction port assembly, and the outlet port being interconnected to the dust collection unit, and wherein the extension pipe pressurizes the actuator when the extension pipe is attached to the cleaner body and the actuator is released when the extension pipe is detached from the cleaner body so that the first path or the second path is selectively switched.

2. The upright vacuum cleaner as claimed in claim 1, wherein the valve housing includes two inlet ports and one outlet port which extend to the same angle on the basis of a center thereof and the rotary valve interconnects any one of the two inlet ports and the outlet port to each other and closes the remaining inlet.

3. The upright vacuum cleaner as claimed in claim 1, wherein when the actuator is pressurized to a linear direction or released and returns to an original position, the rotary valve rotates in a clockwise direction or a counterclockwise direction.

4. The upright vacuum cleaner as claimed in claim 3, wherein the actuator is elastically disposed outside the valve housing.

5. The upright vacuum cleaner as claimed in claim 3, wherein the valve housing includes at least one pair of guide ribs which guide the actuator to the linear direction.

6. The upright vacuum cleaner as claimed in claim 1, wherein actuator includes cam holes which are in cam contact with connection protrusions protruded from an outer circumference of the rotary valve to control rotation of the rotary valve.

7. The upright vacuum cleaner as claimed in claim 6, wherein the cam holes of the actuator have a larger width than a diameter of the connection protrusions to have a clearance with the connection protrusions of the rotary valve.

8. The upright vacuum cleaner as claimed in claim 6, wherein the connection protrusions of the rotary valve are slidably inserted into the valve housing and the valve housing includes guide holes corresponding to a rotational trajectory of the connection protrusions.

9. The upright vacuum cleaner, as claimed in claim 1, wherein the rotary valve includes a hinge hole in which a hinge shaft of the valve housing is inserted and the hinge hole is formed to have a clearance with the hinge shaft.

10. The upright vacuum cleaner as claimed in claim 9, wherein the hinge hole has a circular shape or an elliptical shape.

11. The upright vacuum cleaner as claimed in claim 9, wherein the hinge hole has a circular shape, the hinge hole is an atypical circle.

12. The upright vacuum cleaner as claimed in claim 1, wherein the rotary valve includes a packing which is joined along an outer circumference thereof and is tightly adhered to an inner surface of the valve housing.

13. The upright vacuum cleaner as claimed in claim 1, wherein the actuator has an inverse U shape and is cam-connected to both sides of the rotary valve.

14. The upright vacuum cleaner as claimed in claim 1, wherein the inlet port interconnected to the suction port assembly is disposed in a downward direction of the valve housing and the inlet port interconnected to the hose and the outlet port are disposed left and right.

15. The upright vacuum cleaner as claimed in claim 1, wherein the actuator includes a unit to be pressurized, which the extension pipe duly reaches, in a top thereof.

* * * * *

UNITED STATES PATENT AND TRADEMARK OFFICE

CERTIFICATE OF CORRECTION

PATENT NO. : 8,453,294 B2
APPLICATION NO. : 13/343344
DATED : June 4, 2013
INVENTOR(S) : Byung Jo Lee It is certified that error appears in the above-identified patent and that said Letters Patent is hereby corrected as shown below:

Title Page Col. 1, insert
-- (30) Foreign Application Priority Data
Jan. 17, 2011 (KR) .....10-2011-0004475 --.

In the Claims:
In Col. 8, Line 32, In Claim 9, delete “cleaner,” and insert -- cleaner --, therefor.

Signed and Sealed this
Fifteenth Day of October, 2013

Teresa Stanek Rea
*Deputy Director of the United States Patent and Trademark Office*